US005961558A

United States Patent [19]

Kvamsdal

[11] Patent Number: 5,961,558

[45] Date of Patent: Oct. 5, 1999

[54] CONTROL DEVICE FOR ACHIEVING OPTIMUM USE OF THE ENERGY WHICH IS PRODUCED BY A VESSEL'S MAIN ENERGY SOURCE

[75] Inventor: Rolf Kvamsdal, Oslo, Norway

[73] Assignee: Kvaerner ASA, Lysaker, Norway

[21] Appl. No.: 08/826,837

[22] Filed: Apr. 8, 1997

Related U.S. Application Data

[63] Continuation of application No. PCT/NO95/00205, Nov. 2, 1995.

[30] Foreign Application Priority Data

Nov. 4, 1994 [NO] Norway ..... 944225

[51] Int. Cl.[6] ..... B60L 11/02

[52] U.S. Cl. ..... 701/21; 440/6

[58] Field of Search ..... 701/21, 116, 300, 701/923, 207, 22; 416/131, 140, 30–41; 440/3, 6, 4; 290/4 R; 318/67, 148, 493

[56] References Cited

U.S. PATENT DOCUMENTS

| | | | |
|---|---|---|---|
| 3,686,485 | 8/1972 | Wiley et al. | 701/99 |
| 4,380,206 | 4/1983 | Baitis et al. | 701/21 |
| 4,448,144 | 5/1984 | Senoo et al. | 701/21 |
| 4,836,809 | 6/1989 | Pelligrino | 440/2 |
| 4,872,118 | 10/1989 | Naidenov | 701/124 |
| 5,199,912 | 4/1993 | Dade et al. | 440/6 |
| 5,413,461 | 5/1995 | Johnsen | 701/21 |
| 5,420,795 | 5/1995 | Greene | 701/200 |

FOREIGN PATENT DOCUMENTS

| | | |
|---|---|---|
| 170722 | 10/1990 | Norway . |
| 856 894 | 11/1979 | U.S.S.R. . |
| WO 92/06890 | 4/1992 | WIPO . |

OTHER PUBLICATIONS

MER, Aug. 1993, "MITS paves way for total control integration", "MITS pilot plant onboard Norwegian coastal express vessel", p. 27–p. 28.

Aug. 1994 "Engine control system trends", *MER*.

Aug. 1994 Commercial breakthroughs for Vosper's Vicam system, *MER*, p. 15.

"Stena ferries exploit the benefits of a new vibration monitoring system", *MER*, p. 17.

*Primary Examiner*—Jacques H. Louis-Jacques

*Attorney, Agent, or Firm*—Merchant & Gould, P.C.

[57] ABSTRACT

A control system for achieving optimum use of the energy from a vessel's main energy source. The vessel control system includes a main energy source, a generator device, at least one motor, and a power line network connecting the main energy source, the generator device and the at least one motor. The system further includes a maneuvering device for controlling the main energy source, the generator device and the at least one motor. A global positioning system is provided in the control system, together with a programmable logic control device for receiving information from at least one of the maneuvering device and the global positioning system, and for transmitting control impulses to the at least one motor for operation thereof based on an optimization data program for obtaining desired movement of the vessel. An electric control network connects the main energy source, the generator device and the at least one motor to the maneuvering device, the global positioning system and the programmable logic control device. The programmable logic control device is arranged to receive information concerning a desired movement of the vessel from, e.g. the maneuvering device or the GP system and to transmit control impulses to the motors for the operation thereof based on an optimization data program for achieving the desired movement of the vessel with a minimum energy consumption.

6 Claims, 1 Drawing Sheet

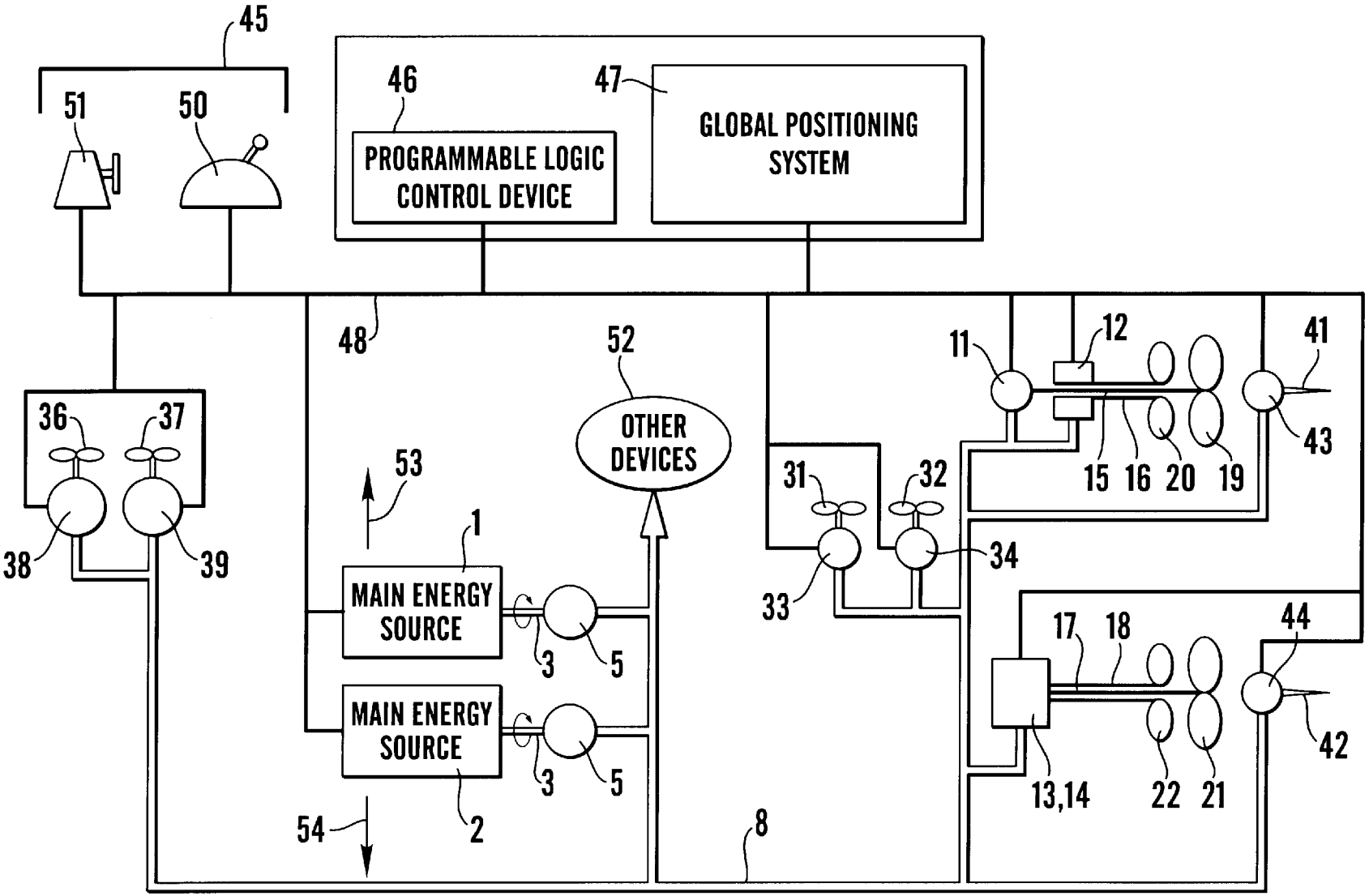
GLOBAL POSITIONING SYSTEM
PROGRAMMABLE LOGIC CONTROL DEVICE
OTHER DEVICES
MAIN ENERGY SOURCE
MAIN ENERGY SOURCE
41
43
42
44
19
20
16
15
12
21
22
18
17
13,14
11
34
32
31
33
8
52
5
5
3
3
1
2
53
54
48
47
46
45
50
51
39
37
36
38

CONTROL DEVICE FOR ACHIEVING OPTIMUM USE OF THE ENERGY WHICH IS PRODUCED BY A VESSEL'S MAIN ENERGY SOURCE

This is a continuation of PCT/NO 95/00205 filed Nov. 2, 1995.

FIELD OF THE INVENTION

The invention concerns a control device for achieving optimum use of the energy which is produced by a vessel's main energy source, this energy being converted to electrical energy possibly via a generator device and supplied via a power-line network to at least one first motor which operates a first device for movement of the vessel in its longitudinal direction, and possibly at least one second motor which operates a second device for movement of the vessel in its transverse direction, together with possible further motors for operation of further devices on board the vessel.

BACKGROUND OF THE INVENTION

From U.S. Pat. No. 5,199,912 (Dade) it is known that a ship's engine can operate an electrical Generator which in turn operates an electric motor for operating a propeller.

From the periodical MER, August 1994, there is known a monitoring and warning system (Vosper Vicam) for a ship's main engine, electrical generators, devices for distribution of the electrical power, together with fuel, air conditioning, pumping, water and fire extinguishing systems.

From NO 170 722 (Johnsen) methods and devices are known for monitoring the optimum operation of variable pitch propellers for use, e.g., together with automatic navigation systems when sailing along given sailing routes. Load cells in the propeller shaft supply impulses to a computer which controls the motor's output and the propeller pitch.

From SU 856 894 it is known that the pitch of a variable pitch ship's propeller can be controlled as a function of disturbances in the ship's movements and that several main engines can be controlled simultaneously. The disturbances can be ongoing or estimated in advance. Ongoing disturbances are obtained from transductors which emit impulses concerning the ship's vertical speed and the first derivative of the ship's trim.

From U.S. Pat. No. 4,836,809 (Pellegrino) it is known that a ship's speed and course can be influenced by means of engines and propellers respectively.

It is further known in the prior art that a ship can be moved along and rotated about relevant major axes by means of a number of water jet units which are individually controlled.

SUMMARY OF THE INVENTION

The object of the device according to the invention is to provide a device of the known type described in the introduction which provides an optimum utilization of the energy, including. e.g. thermal as well as mechanical energy, which can be produced by an energy source on board a vessel to all the energy consumers in the vessel.

The characteristics of the device according to the invention are presented by the characteristic features indicated in the claims.

BRIEF DESCRIPTION OF THE DRAWING

The invention will now be described in more detail with reference to the single FIGURE which is a diagram which schematically illustrates the working connection between an energy source and devices which are operated thereby, and an electrical control circuit for the energy source and the devices, the components of the system being indicated symbolically and located on board a vessel.

DETAILED DESCRIPTION OF PREFERRED EMBODIMENTS

It should be understood that the driven devices described herein are presented as examples, and that the system can comprise fewer or more devices which are operated by the main energy source and that it can comprise a different number of engines than two.

The energy source is composed of two main engines, e.g. two diesel engines 1, 2, each of which drives its respective electrical generator 5, 6 via respective shafts 3, 4. Instead of diesel engines steam or gas turbines, e.g., or a combination of different types of engine can be used.

Separate auxiliary engines are not provided according to the prior art, but only one common energy source for all purposes. The invention can, however, also be employed when a propeller is used which is directly driven mechanically by means of the main engines and in addition the vessel has a number of auxiliary engines.

The generators supple electrical energy to a common power network which is composed of power lines 8, which are indicated by double lines in the FIGURE.

For example, the generators supply energy for operation of the following devices:

Two pairs of electric motors 11, 12 and 13, 14 respectively, each of which via coaxial shafts 15, 16 and 17, 18 respectively operates its respective pair of variable pitch propellers 19, 20 and 21, 22 respectively. The propellers in each pair of propellers or the pairs of propellers can be contra-rotating relative to each other in order to obtain a maximum degree of propulsion efficiency. Fixed or variable pitch single propellers or water jet units can also be provided.

A pair of transverse propellers 31, 32 which are provided at the vessel's stern, and each of which is operated by its own electric motor 33, 34.

A pair of transverse propellers 36, 37 which are provided at the vessel's bow, and each of which is operated by its own electric motor 38, 39. The invention can also be employed without transverse propellers. In this case, however, the functional possibilities are reduced, especially during manoeuvring.

Two rudders 41, 42 which are provided behind each pair of propulsion propellers 19, 20 and 21, 22, and each of which can be pivoted by means of its respective steering machinery 43, 44. This can, e.g., be electrohydraulic. The rudders 41, 42 are of the type which can be retracted into the hull. e.g. by means of electrohydraulic equipment (not shown). In the same way associated electric motors can be driven by the generators.

Waste heat from the engines 1, 2, indicated by the arrows 53, 54, can be used for heating, desalination of sea water, absorption refrigerating plants, etc..

The motors 11–14, 33, 34, 38, 39 can be frequency controlled, thus enabling their rotation speed to be varied.

Furthermore the generators 5, 6 can supply electrical energy to other devices on board the vessel (not shown), such as winches, fans, pumps, water heaters, lighting, etc., these devices being indicated only by the reference number 52.

For controlling the engines (1, 2) and the energy supply to those devices which receive energy therefrom, a control device has been provided which comprises a manoeuvrable control impulse emission device, hereinafter called manoeuvring device 45, a programmable, logic control device, hereinafter called PLS device 46.

a global positioning system 47, hereinafter called GP system, an electrical control network which via electrical control cables 48 links the main engines 1, 2, the generators 5, 6 and the motors 11–14, 33, 34, 38, 39 to the above-mentioned remaining components of the control device. The control cables 48 are illustrated by a single line in the FIGURE.

The device ensures that the correct number of motors is in operation at any time, and it can stop or start motors depending on the energy requirements.

The manoeuvring device comprises a control stick device 50 of the type which has a control stick, one end of which is mounted via a universal joint, and which is arranged for simultaneous control of all the propeller motors 11–14, 33, 34, 38, 39 during manoeuvring in order to achieve by means of this single control stick a controlled movement of the vessel along and about the above-mentioned major axes, including turning of the vessel about any point along its longitudinal axis.

The manoeuvring device further comprises a steering wheel device 51 for controlling the rudder motors 42, 43.

At high speed the rudders are partially retracted for reduction of the hydraulic resistance. In a twin-propeller unit as illustrated, the rudders can be completely retracted, whereby the steering of the vessel is performed by varying the power to the two propellers.

The PLS device is arranged to receive information concerning a desired movement of the vessel from the manoeuvring device 45 and to coordinate this information with information concerning the vessel's actual movement from the GP system, possibly also from sensors and gyros (not shown), and transmit control impulses to the motors for control thereof based on an optimization programme for obtaining a desired movement of the vessel with a minimum energy consumption.

The device also ensures that the rudders are retracted and provides for the transfer to power steering in the case of multi-propeller units.

Together with information from, e.g., weather satellites and electronic charts, data concerning traffic, etc., the control system is arranged to steer the vessel to its destination alone an optimum path whilst, e.g., evading storms without risk of running aground or colliding with other vessels, and with a minimum energy consumption.

I claim:

1. A vessel control system including:

a main energy source;

a generator device for converting energy produced by the main energy source into electrical energy;

at least one motor operating at least one movement device for movement of the vessel;

a power line network connecting the main energy source, the generator device and the at least one motor;

a maneuvering device for controlling the main energy source, the generator device and the at least one motor;

a global positioning system;

a programmable logic control device for receiving information from at least one of the maneuvering device and the global positioning system, and for transmitting control impulses to the at least one motor for operation thereof based on an optimization data program for obtaining desired movement of the vessel; and an electric control network connecting the main energy source, the generator device and the at least one motor to the maneuvering device, the global positioning system and the programmable logic control device, wherein the control system achieves optimum use of the energy produced by the main energy source of the vessel.

2. The vessel control system of claim 1, wherein the vessel control system includes a first motor operating a first movement device for movement of the vessel in a longitudinal direction, and wherein the first movement device comprises a pair of propulsion propellers actuated by respective coaxial shafts driven by the first motor.

3. The vessel control system of claim 1, further including at least one plate-shaped rudder behind the at least one movement device, wherein the at least one plate-shaped rudder is arranged for retraction into a hull of the vessel.

4. The vessel control system of claim 1, wherein the vessel control system includes a second motor operating a second movement device, and wherein the second movement device comprises at least one transverse propeller.

5. The vessel control system of claim 1, wherein the programmable logic control device is arranged for calculation of a sailing route with optimum utilization of energy with regard to a condition of the intended sailing area, sea conditions and weather conditions.

6. The vessel control system of claim 1, wherein the maneuvering device includes a control stick for maneuvering the vessel through the at least one movement device, and a steering wheel.

* * * * *